United States Patent [19]

Fukuchi et al.

[11] Patent Number: 4,702,987

[45] Date of Patent: Oct. 27, 1987

[54] DEVELOPING METHOD FOR ELECTROPHOTOGRAPHY

[75] Inventors: Masakazu Fukuchi; Satoshi Haneda, both of Tokyo, Japan

[73] Assignee: Konishiroku Photo Industry Co., Ltd., Japan

[21] Appl. No.: 938,557

[22] Filed: Dec. 5, 1986

[30] Foreign Application Priority Data

Dec. 28, 1985 [JP] Japan ..... 60-298509
Dec. 31, 1985 [JP] Japan ..... 60-299095

[51] Int. Cl.[4] ..... G03G 13/09
[52] U.S. Cl. ..... 430/122; 118/657
[58] Field of Search ..... 430/122; 118/657

[56] References Cited

U.S. PATENT DOCUMENTS 4,473,627 9/1984 Kambe et al. ..... 430/122

*Primary Examiner*—J. David Welsh
*Attorney, Agent, or Firm*—James E. Nilles

[57] ABSTRACT

A developing method of developing an electrostatic latent image in an alternating electric field in a noncontact manner wherein a reversal development is conducted by setting the rate of feeding a developer to a developing region within a range of 0.01 to 0.04 g/cm$^2$. The developing is carried out with a two-component developer consisting of a magnetic carrier and a nonmagnetic toner.

8 Claims, 15 Drawing Figures

DEVELOPING METHOD FOR ELECTROPHOTOGRAPHY

BACKGROUND OF THE INVENTION

1. Field of the Invention

The present invention relates to a developing method and, more particularly, to a developing method of visualizing an electrostatic latent image formed on an image retainer in electrophotography.

2. Description of the Prior Art

As a developing apparatus to be used for the above-specified development, the following apparatus is widely adopted because its size reduction is feasible. More specifically, a developing sleeve acting as a developer feeding member has its surface formed of a magnetic brush of a magnetic developer by the action of a magnet disposed at the back thereof, and the magnetic developer is fed to a developing zone to apply a toner under a developing bias to an electrostatic latent image on a image retainer.

In recent years, the demands for increasing the reproducing speed and density of the copies of an electrophotographic reproducing apparatus have become more and more intense to make it accordingly desirable to speed up the movement of the image retainer thereby to assure development of the electrostatic latent image within a short period. On the other hand, the promoted trend of coloring papers in offices and so on has enhanced the need for reproducing colored hard copies. It has also been desired to provide a developing method which is appropriate for realizing a color reproducing apparatus having a high resolution and an excellent color reproducibility.

In order to satisfy the desire for speeding up the development, it is conceivable to use a developing apparatus which is equipped with a plurality of developing sleeves. This apparatus will enlarge the developing apparatus to lose the aforementioned merits.

The developer is generally divided into a one-component developer composed of a magnetic toner and a two-component developer composed of a non-magnetic toner and a magnetic carrier. The latter two-component developer is appropriate for the color reproduction partly because it can obtain a toner image of clear color without any necessity for containing a black or brown magnetic component in the toner and partly because it is feasible to control the charge of the toner. In a color reproducing method in which toner images of plural colors are formed and superposed on an image retainer (i.e., a photosensitive member), a non-contact developing method is appropriate, in which the development is conducted by keeping a magnetic brush out of contact with the image retainer so that the toner image or images previously developed may not be broken. The non-contact development is a method in which an a.c. and/or d.c. bias is applied to the developer feeding member to form an alternating electric field in a developing region, while the developer on its member being kept away from the image retainer, thereby to float the toner and attach on the electrostatic latent image.

As the developing method using the two-component developer in a non-contact or quasi-contact manner, there can be enumerated Japanese Patent Laid-Open Publication Nos. 56-144452, 57-139761, 59-67565, 59-91453, 59-121077, 59-154469 and 59-181362.

Unless the development is sufficient for color reproductions with color toners, the copies obtained are so badly reproducible that they provide poor appearances. In the color reproductions of the prior art, therefore, the magnetic brush is rotated at a high speed for the development. However, this development has a high rotational torque, leaves traces of the brush, and provides insufficient density. As a result, it is the current practice that copies of satisfactory image qualities cannot be obtained.

In the reversal development, in addition to the above-specified problems, there arises another troublesome problem that a developer charged with an opposite polarity to that of the electrostatic charges on the photosensitive member is liable to stick to the non-image portion (i.e., the white background), especially the non-image portion around the image portion (i.e., the colored portion) thereby to deteriorate the image quality due to fogging and to waste the development.

SUMMARY OF THE INVENTION

It is an object of the present invention to provide a developing method which is freed from having its developing apparatus enlarged and from requiring any excessive torque by rotating the magnetic brush at a high speed but can give a high developing efficiency and a high density development with neither any fogging nor any brush trace.

After having been devoted to investigations, we have found that the developer is enabled to freely move all over its layer on a developer feeding member by having its feeding rate set within a range of 0.01 to 0.04 g/cm$^2$ and is stirred and mixed from its lower to upper surfaces in a frequently repeated manner by applying an alternating magnetic field to it so that the developer components are so sufficiently charged as to be developed in the alternating electric field thereby to achieve an improvement in the developing efficiency and a uniform developability. The present invention is conceived on the basis of the above-specified findings.

If the feeding rate of the developer is smaller than 0.01 g/cm$^2$, the visible image obtainable has an insufficient density. If the developer feeding rate exceeds 0.04 g/cm$^2$, on the other hand, the developer will also stick to the non-image portion (i.e., the white background) to cause the fogging, and the carrier is also liable to stick to the peripheral edges and so on of the image portion, thus making it impossible to form a visible image of excellent quality.

According to a feature of the present invention, there is provided a developing method of developing an electrostatic latent image in an alternating electric field in a noncontact manner, characterized in that a reversal development is conducted by setting the rate of feeding a developer to a developing region within a range of 0.01 to 0.04 g/cm$^2$.

According to another feature of the present invention, there is provided a developing method of developing an electrostatic latent image with a two-component developer in an alternating electric field in a noncontact manner, characterized in that a development is conducted in an alternating magnetic field by setting the rate of feeding a developer to a developing region within a range of 0.01 to 0.04 g/cm$^2$.

The present invention will become apparent from the following description taken in connection with the embodiment thereof with reference to the accompanying drawings.

DESCRIPTION OF THE PREFERRED EMBODIMENT

Before entering into the description of the specific embodiment of the present invention, a non-contact developing method suitable for application to the present invention will be described in the following.

Figure 1:
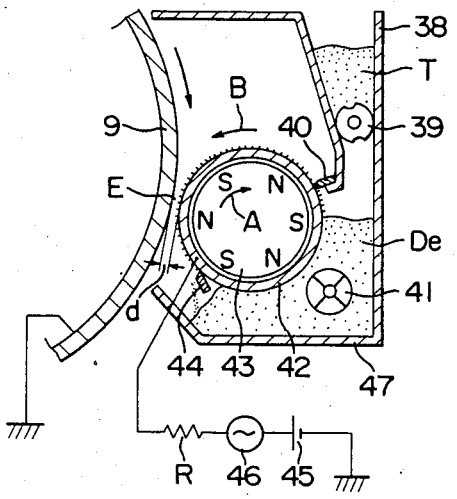
FIGS. 1, 5 and 12 are sectional views showing developing apparatus.

It has been made apparent that an excellent image cannot be formed even if the values of a gap d (mm) between an image retainer in a developing region and a developer feeding member (which may be referred to merely as the "gap") and the voltage $V_{AC}$ and the frequency f (Hz) of the a.c. component of a developing bias are determined independently of one another, and that those parameters correlate closely to one another. Therefore, experiment have been conducted by using a developing apparatus, as shown in FIG. 1, with the parameters of the voltage, frequency and so on of the a.c. component of the developing bias varied, to provide the results shown in FIGS. 2 and 3. In a developing device 11, a developer De is fed in the direction of arrow B on the circumference of a non-magnetic sleeve 42 to a developing region E by rotating the non-magnetic sleeve 42 and a magnetic roll 43 acting together as the developer feeding member. Incidentally, the developer De is of two-component type composed of a magnetic carrier and a non-magnetic toner. The carrier is a ball-shaped carrier coated with a resin and having an average particle diameter of 30 μm, a magnetization of 50 emu/g, and a resistivity of $10^{14}$ Ωcm or more. Incidentally, the resistivity has a value obtained by reading a current value when particles are tapped in a container having a sectional area of 0.50 $cm^2$ and then loaded by a load of 1 $kg/cm^2$ and when a voltage for establishing an electric field of 1,000 V/cm is applied between the load and a bottom electrode. The toner used is prepared to have an average particle diameter of 10 μm by adding a small quantity of charge control agent to 90 wt % of a thermoplastic resin and 10 wt % of a pigment (e.g., carbon black) and by kneading and pulverizing them. The developer De is fed in the direction of the arrow B when the magnetic roll 43 rotates in the direction of the arrow A whereas the sleeve 42 rotates in the direction of the arrow B. The developer De has its thickness regulated, while it is being fed, by an ear regulating blade 40. A developer reservoir 47 is equipped therein with a stirring screw 41 for sufficiently stirring it so that a toner T is supplied from a toner hopper 38 by a rotating toner supply roller 39 when the toner in the developer reservoir 47 is consumed. For developing operations, there is connected a d.c. power source 45 for applying a developing bias between the sleeve 42 and a photosensitive drum 9 acting as the image retainer. In series with the d.c. power source 45, there is connected an a.c. power source 46 for vibrating the developer De in the developing region E so that the same De may be sufficiently fed to the photosensitive drum 9. Reference letter R denotes a protecting resistor.

Figure 2:
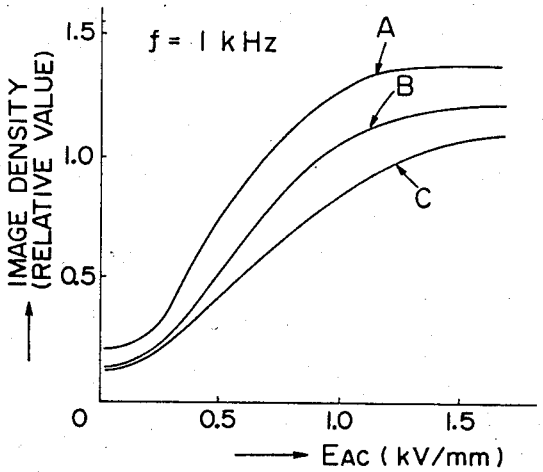
FIGS. 2 and 3 are graphs showing the variations of an image density when an a.c. bias voltage is varied.

FIG. 2 shows the relationship between the amplitude of the a.c. component, when the gap d between the photosensitive drum 9 and the sleeve 42 is set at 1.0 mm, when the layer thickness of the developer is set at 0.5 mm, when the charging potential of the photosensitive member is set at 600 V, and when the developing bias has its d.c. component set at 200 V and its a.c. component set to have a frequency of 1 kHz, and the density of the toner image formed in the exposed portion (where the potential is 0 V) on the photosensitive drum 9. The amplitude $E_{AC}$ of the intensity of the a.c. electric field takes a value which is obtained by dividing the amplitude $V_{AC}$ of the a.c. voltage of the developing bias by the gap d. Curves A, B and C, as plotted in FIG. 2, indicate the results in case the average charges of the toners used are controlled to 30 μC/g, 20 μC/g and 15 μC/g, respectively. As commonly seen from the three curves A, B and C, the effect of the a.c. component of the electric field appears for the amplitude of the a.c. component equal to or larger than 200 V/mm.

Figure 3:
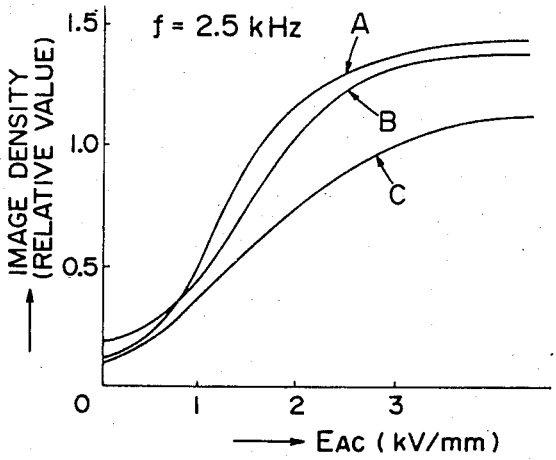

FIG. 3 shows the variation of the image density when the frequency of the a.c. component of the developing bias is set at 2.5 kHz whereas the intensity $E_{AC}$ of the a.c. electric field is varied under the same conditions as those of the experiments of FIG. 2.

According to these experimental examples, it has been found that the image density increases when the aforementioned amplitude $E_{AC}$ of the intensity of the a.c. electric field exceeds 500 V/mm.

Incidentally, as seen from the results of FIGS. 2 and 3, the image density highly varies across those certain amplitudes, which are obtained in little dependence upon the average charges of the toners, as viewed from the curves A, B and C. The reason for this is thought to come from the following phenomena. In the two-component developer, more specifically, it is forecast that the toners are charged by their frictions with their carriers or one another with their charges distributed over a wide range, and it is thought that the toners having higher charges are predominantly developed. It is also thought that the ratio of occupation of those toners having greater charges is not so highly varied, even if the average charge is controlled by the action of a charge control agent, that a large change, if any, in the developing characteristics is not observed.

Figure 4:
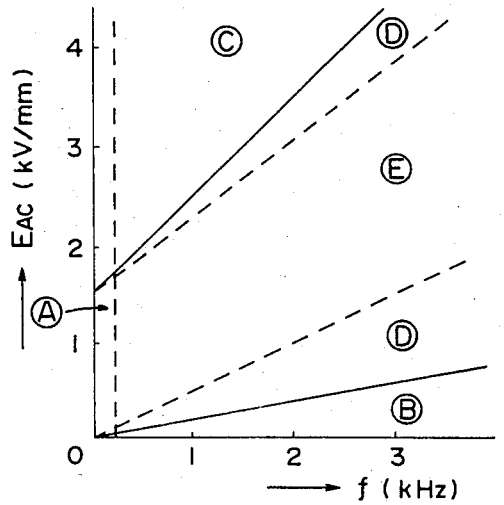
FIG. 4 is a graph showing the characteristics of an image density when the intensity of an electric field and the frequency of the a.c. bias are varied.

Here, experiments similar to those of FIGS. 2 and 3 are conducted under different conditions and can be rearranged in respect to the relationship between the amplitude $E_{AC}$ and the frequency f of the intensity of the a.c. electric field to provide the results shown in FIG. 4.

In FIG. 4: letter A indicates a zone where the development is liable to become uneven; letter B indicates a zone where the effect of the a.c. component does not appear; letter C indicates a zone where the toners are liable to return back to the sleeve 42; letters D and E indicates zones where the effect of the a.c. component appears to ensure a sufficient developing density without any breakage of the toner image or images already formed; and the zone E is especially preferred.

In the zone where the image density has a tendency to increase with respect to the amplitude $E_{AC}$ of the intensity of the a.c. electric field, i.e., the zone where the amplitude $E_{AC}$ of the intensity of the a.c. electric field takes a value of 0.2 to 1.2 kV/mm with respect to the density curve A of FIG. 2, for example, the a.c. component of the developing bias operates to make it liable to exceed a threshold value, at which the toners are floated from the sleeve, so that even the toners having low charges are trapped by the photosensitive drum 9 for the developing operations. As a result, the image density is increased the more as the amplitude of the intensity of the a.c. electric field becomes the larger.

For the zone where the image density is saturated for the amplitude $E_{AC}$ of the intensity of the a.c. electric field, i.e., the zone where the amplitude $E_{AC}$ of the intensity of the a.c. electric field is equal to or higher than 1.2 kV/mm in the curve A of FIG. 2, on the other hand, those phenomena can be explained in the following manner. In this zone, more specifically, the toners vibrate the more highly for the larger amplitude of the intensity of the a.c. electric field, and the cluster composed of aggregated toners is liable to be broken so that only the toners having greater charges are selectively trapped by the photosensitive drum 9 whereas the toner particles having smaller charges become reluctant to be developed. Moreover, the toners having the smaller charges are liable to be returned to the sleeve 42 by the a.c. bias because they have a weak mirroring power even if they have once been trapped by the photosensitive drum 9. Moreover, the charges are caused to leak from the surface of the photosensitive drum 9 owing to the excessive amplitude of the intensity of the electric field of the a.c. component, thus making the phenomenon liable to occure, in which the toners become reluctant to be developed. It is thought that those factors are superposed as a matter of fact to make the image density constant against the increase in the a.c. component.

Under the conditions of the developing bias suitable for the developing method of the present invention, the term of $V_{AC}/(d.f)$ is preferably set within the following range, if the amplitude and the frequency of the a.c. component of the developing bias are denoted at $V_{AC}$ (V) and f (Hz), respectively, and if the gap between the image retainer and the developer feeding member is denoted at d (mm):

$$0.4 \leqq V_{AC}/(d \cdot f) \leqq 1.2.$$

The two-component developer to be sued in the present invention is especially preferably composed of a magnetic carrier as its carrier and a non-magnetic toner as its toner.

The toner generally has the following composition:

(1) Thermoplastic Resin: Binder, 80 to 90 wt %
  Example: Polystyrene, styrene-acryl copolymer, polyester, polyvinylbutyral, epoxy resin, polyamide resin, polyethylene and ethylene-vinylacetate copolymer may frequently be mixed and used;

(2) Pigment: Coloring Agent, 0 to 15 wt %
  Example:
    Black: carbon black;
    Blue: dielectric dye of copper phthalocyanine or sulfonamide;
    Yellow: benzidine derivatives; and
    Magenta: polytungstophosphoric acid, rhodamine B lake or carmine 6B;

(3) Charge Controller: 0 to 5 wt %
  Example:
    Positive: niglosine group (as electron donor); and
    Negative: organic complex (as electron receptor);

(4) Fluidizing Agent:
  Example:
    Representatives:
      colloidal silica or hydrophobic silica; and
    Others:
      silicone varnish, metallic soap or nonionic surface-active agent;

(5) Cleaning Agent:
  This agent acts to prevent the toners in the photosensitive member from filming.
  Example:
    Metallic salt of fatty acid, oxidized silicic acid having organic radicals on the surface, or fluorine-contained surface-active agent;

(6) Filler:
  This aims at improving the surface luster of an image and reducing the raw material cost.
  Example:
    calcium carbonate, clay, talc or pigment.

These materials may additionally contain a magnetic material for preventing the fogging and the toner dispersion.

As the magnetic powder, there has been proposed powder of ferrosoferric oxide, γ-ferric oxide, chromuim dioxide, nickel ferrite or iron alloy having a particle diameter of 0.1 to 1 μm. At present, the ferrosoferric oxide is frequently used and contained 0.5 to 75 wt % with respect to the toners. Although the toners have their resistance considerably varied according to the kind and quantity of the magnetic powder, the quantity of the magnetic material is preferably equal to or lower than 55 wt % so as to obtain a sufficient resistance. In order to maintain a clear color as a color toner, on the other hand, the quantity of the magnetic material may desirably be equal to or lower than 10 wt %, especially 0.5 to 5 wt %.

As resin suitable as pressure fixing toners, moreover, adhesive resin such as wax, polyorefins, ethylene-vinylacetate copolymer, polyurethane or rubber are selected so that they may be plastically deformed and adhered to paper by force of about 20 kg/cm. A capsule toner may also be used.

The above-enumerated materials can be used to prepare the toners by the method which is well known in the art.

In the construction of the present invention, the toner particles are usually desired to have an average diameter of about 50 μm or less in relation to the resolution so that a more preferable image may be formed. Although no restriction is placed on the toner particle diameters on principle by the present means, the diameter preferably used is usually about 1 to 15 μm in relation to the resolution and the toner dispersion and feed.

In order to clear fine points or lines or to improve the gradation, the magnetic carrier particles are particles composed of magnetic particles and a resin, such as magnetic ones made of a resin-dispersed system of magnetic powder and a resin or coated with a resin and may preferably be spherical and have an average diameter of 50 μm or less, more preferably 5 to 30 μm.

Moreover, in order to eliminate the problem that charges are made liable to be injected by the bias voltage into the carrier particles obstructing the formation of an excellent image to stick the carriers to the surface of an image retainer or that the bias voltage is not sufficiently applied, the carriers are desired to have a resistivity of $10^8$ Ωcm or more, preferably $10^{13}$ Ωcm or more, more preferably $10^{14}$ Ωcm or more and to have the aforementioned particle diameter.

The carriers thus made into fine particles can be prepared either by coating the surfaces of the magnetic material with the thermoplastic resin, both of which have been described in connection with the toners, or by forming the particles of a resin having magnetic fine particles dispersed and contained therein, and by selecting the diameter of the formed particles by the average particle diameter selecting means well known in the art. The carriers are desirably rounded so as to improve the stirability of the toners and carriers and feedability of the developer and to improve the charge controllability of the toners thereby to make either the toner particles or the toner and carrier particles reluctant to aggregate. The round magnetic carrier particles are prepared by selecting magnetic particles as spherical as possible for the resin-coated carrier particles and coating them with a resin, by using magnetic fine particles, if possible, for the magnetic fine particle dispersed carrier and rounding them with hot wind or water after the formation of the dispersed resin particles, or by directly forming the round dispersed resin particles by a spray drying method.

The feed rate of the developer, as defined herein, will be described in the following.

As shown in FIG. 1, the developer De has its feed rate regulated by the ear regulating blade 40 so that it is carried and fed at a predetermined rate onto the sleeve 42 by the relative rotations of the sleeve 42 and the magnetic roll 43. In the developing region E, the developer De having its feed rate regulated faces but does not contact with the electrostatic latent image on the photosensitive drum 9 so that the latent image is developed by the toner by the total actions of the latent image electric field, the developing bias and the magnetic force. Here, the feed rate of the developer is defined as the weight of the developer being fed per unit surface area of the sleeve 42 in the developing region E, i.e., as the quantity of the developer which is contributable to the development.

For example, the feed rate of the developer is calculated into 0.025 g/cm$^2$ in case the weight of the developer on the surface area of 10 cm$^2$ of the developer feeding member is 0.25 g.

Figure 5:
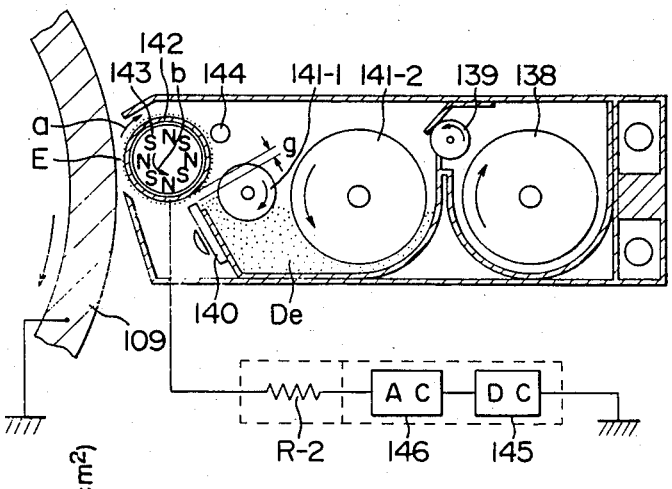

FIG. 5 is a sectional view showing the developing device used in later-described experiments.

In FIG. 5: reference numeral 138 denotes a toner supplying device; numeral 139 a sponge roller; numerals 141-1 and 141-2 developer stirring members; numeral 144 a scraper; numeral 142 a developing sleeve; numeral 143 a magnetic roll; numeral 140 an ear regulating blade; characters R-2 a resistor; numeral 146 an a.c. power source; and numeral 145 a d.c. power source.

The toner supplied from the toner supplying device 138 is delivered by the actions of the sponge roller 139 and the stirring members 141-1 and 141-2 into a developing portion constructed of the developing sleeve 142 and the magnetic roll 143. On the developing sleeve 142, there is formed a layer of the developer De which is composed of the toners and the carriers while having its thickness regulated to a constant value by the ear regulating blade 140 and by which is developed a latent image formed on the surface of a photosensitive drum 109. The scraper 144 operates to scrape off the developer from the surface of the sleeve 142 after the development. Incidentally, arrow a indicates the direction of movement of the developer De, and arrow b indicates the direction of rotations of the magnetic roll 143. The developing sleeve 142 is connected through the resistor R-2 with the a.c. power source 146 and the d.c. power source 145 so that the developing bias is applied between the sleeve 142 and the photosensitive drum 109.

Preparatory Experiment

Figure 6:
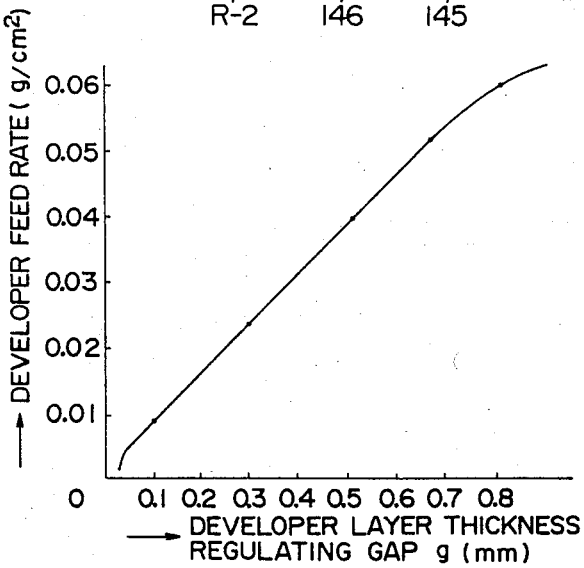
FIG. 6 is a graph showing the relationship between a gap for regulating the thickness of a developer layer and the feeding rate of a developer.

The results, as plotted in FIG. 6, were obtained by examining the relationship between the gap g (which will be called as "developer layer thickness regulating gap") between the sleeve 142 and the ear regulating blade 140 and the feed rate of the developer in the developing region E.

The running conditions of the developing device are as follows:

Sleeve: ϕ 24 mm, made of non-magnetic stainless steel without surface machining;
Sleeve R.P.M.: 30 r.p.m.;
Magnetic Rolls in alternate NS arrangement: 10 poles;
Magnetic Roll R.P.M.: 800 r.p.m.;
Magnetic Roll Surface Magnetic Flux Density: 800 gausses;
Developer:
- Carrier: Resin-dispersed type magnetic carrier;
  - Specific resistance ≧$10^{13}$Ωcm;
  - Weight-based average particle diameter: 20 μm;
  - Magnetization about 50 emu/g (in the magnetic flux density of 1,000 gausses);
- Toner: Weight-based average particle diameter: 11 μm;
- Fluidizing Agent: Hydrophobic silica, 0.4 wt% to the toner weight;
- Toner Density: 20 wt%; and
- Ear Regulating Blade: Non-magnetic blade.

From FIG. 6, it is seen that the developer layer thickness regulating gap g has a linear relationship to the developer feed rate so that they are proportional to each other, if it is within a range of 0.1 to 0.65 mm.

Other experiments similar to the aforementioned one were conducted with the sleeve 142 ranging from 10 to 300 r.p.m. and the magnetic roll 143 ranging to 100 to 1,500 r.p.m., and results substantially similar to those of FIG. 6 were obtained. It can be understood that the developer layer thickness regulating gap g is a major factor for determining the developer feed rate under the above-specified conditions.

Experiment 1

The r.p.m. of the magnetic roll 143 was varied to determined the surface potential of the image portion (i.e., the portion formed with the electrostatic latent image) of the photosensitive drum 109 and the image density.

The running conditions were as follows:

1. Photosensitive Drum:
   a. Photosensitive Layer: made of Se; and
   b. Linear Velocity: 150 mm/sec.
2. Surface Potential:
   a. Charging Potential: +1,000 V;
   b. Image Portion Potential: +900 V; and
   c. Exposed Portion Potential: +0 V.
3. Developer:
   a. Carrier:
      Magnetic powder dispersed system:
      Average particle diameter (weight-based): 20 μm;
      Specific resistance: $10^{14}\Omega$cm or more; and
      Magnetization: about 50 emu/g (δ1 000),
      δ1 000: Magnetization in magnetic flux density of 1,000 gausses.
   b. Toner:
      Resin: Styrene-acryl group; and
      Average Particle Diameter (weight-based): 11 μm.
4. Developing Device:
   a. Sleeve:
      Made of non-magnetic stainless steel having a diameter of 24 mm; and
      Linear velocity: 30 mm/sec.
   b. Magnet:
      8 poles;
      Sleeve surface magnetic flux density: 800 gausses; and
      Rotated at 100~1,500 r.p.m.
5. Developing Conditions:
   a. Shortest Gap between Photosensitive Member and Sleeve: 0.9 mm;
   b. Regulating Gap: 0.3 mm; and
   c. Developing Bias:
      A.C. Component:
         Voltage (effective value): 1.O kV;
         Frequency: 2 kHz and
         D.C. Component: +650 V;
   d. Developer Feed Rate: 0.024 g/cm$^2$.

Figure 7:
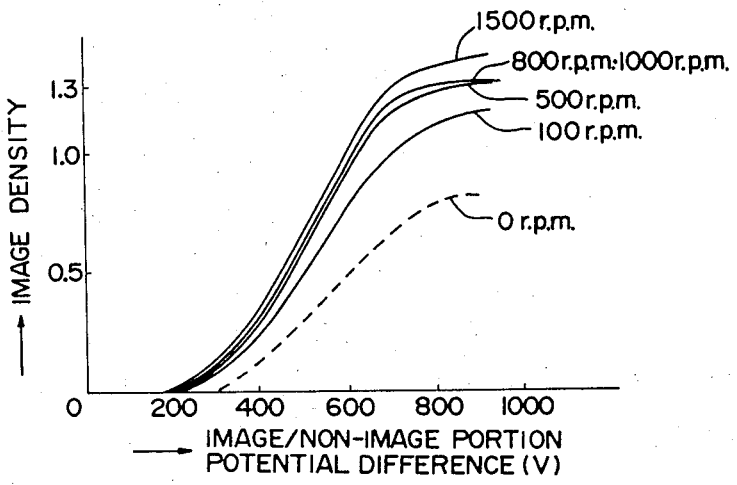
FIG. 7 is a graph showing the relationship between the potential of an image portion and the image density.

The results are plotted in FIG. 7.

In case the magnetic roll was rotated at 100 to 1,500 r.p.m., the image density reached and exceeded 1.0 for a surface potential difference of about 600 V between the image and non-image portions, and a sufficient density was obtained for the potential difference of 800 V. In case the magnetic roll was not rotated but fixed (i.e., at 0 r.p.m.), the results were that the feed of the developer was neither stable nor sufficient so that the surface of the sleeve was uneven to make the image density uneven and low.

Figure 8:
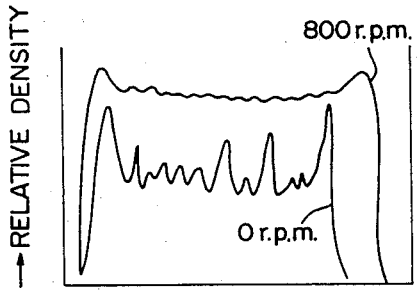
FIG. 8 is a graph showing the variations of the image density taken at right angles with respect to a developing direction.

The evenness of the developed image was different between the cases in which the magnetic roll was rotated and fixed. FIG. 8 shows an example in which the image portion was scanned by means of a reflective type densitometer. The scanning direction was at a right direction with respect to the developing direction.

Experiment 2

The feed rate of the developer was varied by varying the developer layer thickness regulating gap g to determine the relationship between the developer feed rate and the image density.

The running conditions were the same as those of the foregoing Experiment 1 except that the magnetic roll 143 was rotated at 800 r.p.m.

Figure 9:
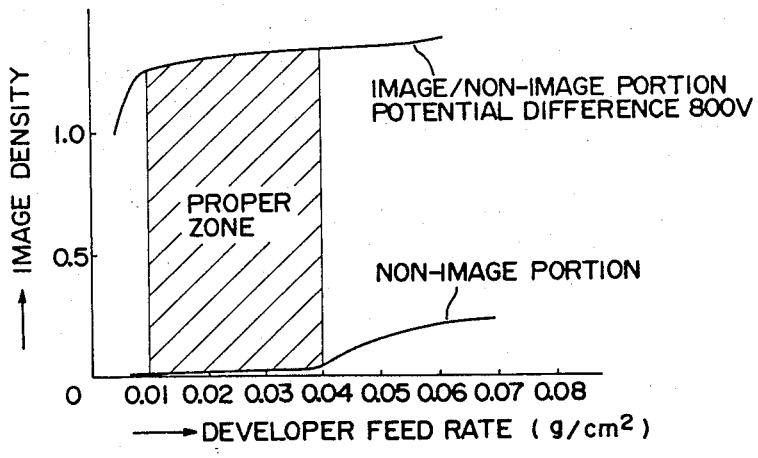
FIG. 9 is a graph showing the relationship between the feeding rate of the developer and the image density.

The results were plotted in FIG. 9.

The density of the image portion dropped for a developer feed rate lower than 0.01 g/cm$^2$, and the density of the non-image portion was fogged for a developer feed rate higher than 0.04 g/cm$^2$.

In case the feed rate was lower than 0.01 g/cm$^2$, the density was icnreased as the gap between the photosensitive drum 109 and the sleeve 142 was narrowed, then it was difficult to make the gap accurate for an excessively narrow gap. The feed of the developer undesirably became uneven.

If the feed rate exceeded 0.04 g/cm$^2$, the fogging was eliminated for a wide gap, but the density had a tendency to drop. Moreover, the toner scatter undesirably increased. Still moreover, the carrier scatter and stick undesirably became gradually prominent.

Experiment 3

The developing method of the present invention was applied to the color image recording methods which had been previously disclosed by us in Japanese Patent Laid-Open Publications Nos. 75850/1985 and 76766/1985 and Japanese Patent Application No. 166549/1985.

Figure 10:
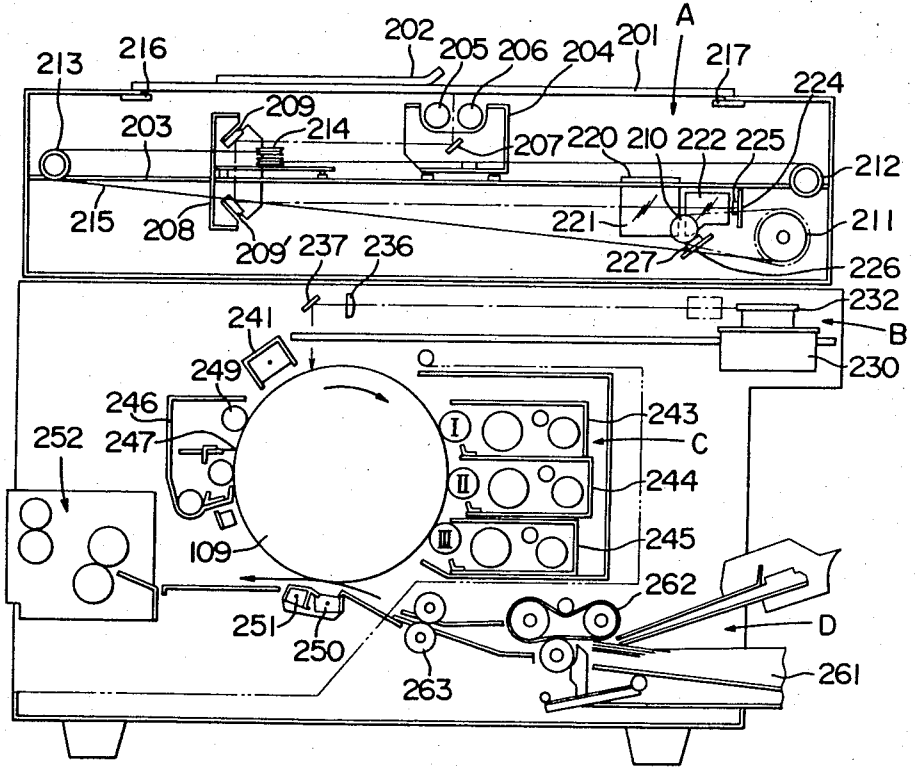
FIG. 10 is a schematic diagram showing a color image forming apparatus.

FIG. 10 shows a color image forming apparatus.

This apparatus is the so-called "digital type color reproducing machine" for forming an electrostatic latent image by optically scanning an original document and separating the colors of the resultant optical image with a dichroic prism, by receiving the individual separated lights with a line image sensor (e.g., a CCD) and converting them into electric signals and further into digital signals, and by writing the color signals of the document obtained from a color separating circuit or the like in a photosensitive member by means of a writing device such as a semiconductor laser or an LED liquid crystal head. The developing method was of the normal or reversal developing type.

In FIG. 10, reference letters A, B, C and D denote a read unit, a write unit, an image forming unit, and a paper supplying unit, respectively.

In the read unit A, reference numeral 201 denotes a platen glass, on which is placed an original document 202. This document 202 is illuminated by fluorescent lamps 205 and 206 which are carried on a carriage 204 moving on slide rails 203. On these slide rails 203, there is movable a mirror unit 208 which carries mirrors 209 and 209' which in turn are combined with a first mirror 207 carried on the carriage 204 to read out the optical image of the document 202 on the platen glass 201 and guide it out to a lens read unit 220.

The carriage 204 and the movable mirror unit 208 are driven in a common direction at respective speeds of V and ½ V by the coactions of pulleys 211, 212, 213 and 214 which in turn are driven through a wire 215 by a stepping motor 210. The platen glass 201 is equipped with reference white plates 206 and 205 on the backs of its two end portions so that reference white signals may be obtained before the start of the document reading and scanning operations and after the end of the scanning operation.

The lens reading unit 220 is constructed of a lens 221, a prism 222, a first read substrate 224, a red channel (which will be shortly referred to as "R-ch") CCD 225, a second read substrate 226, and a cyan channel (which will be shortly referred to as "C-ch") CCD 227. The optical document image transmitted by the first mirror 207 and the mirrors 209 and 209' is focused by the lens 221 and separated into an R-ch image and a C-ch image by a dichroic mirror 223 mounted in the prism 222, until the R-ch and C-ch images are focused, respectively, on the light receiving faces of the R-ch CCD 225 placed on the first read substrate 224 and the C-ch CCD 227 placed on the second read substrate 226.

The fluorescent lamps 205 and 206 used are commercially available warm-white type ones for preventing a specified color from being stressed or decayed on the basis of a light source when the color document is to be read out. Moreover, the fluorescent lamps 205 and 206 are lit by a high-frequency power source of 40 kHz for preventing the flickering and are heated by a heater using a posistor so as to maintain the tube wall at a constant temperature or promote the warm-up.

The image signals outputted from the aforementioned R-ch CCD 225 and C-ch CCD 227 are processed in a later-described signal processing unit E. Color signals having their colors separated in accordance with later-described toner colors are outputted from the signal processing unit E and inputted into the write unit B.

Figure 11:
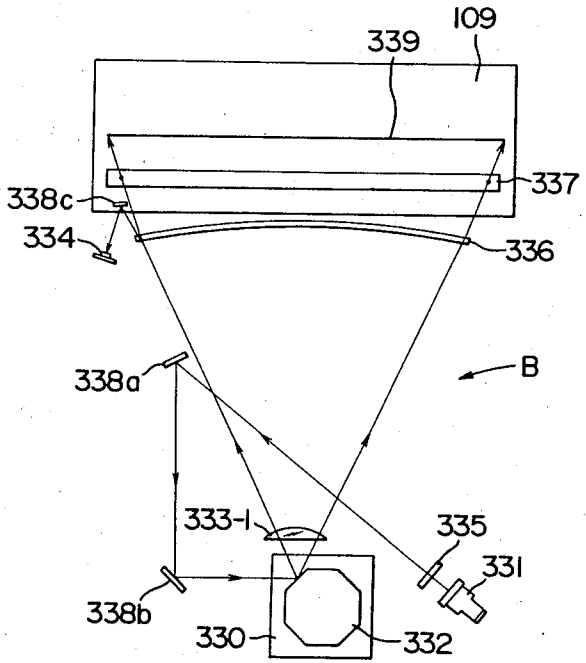
FIGS. 11 and 13 are schematic diagrams showing a laser writing system.

This write unit B is so constructed as is shown in FIG. 11. A laser beam emitted from a semiconductor laser 331 is rotationally scanned by a polygonal mirror 332 being rotated by a drive motor 330 and has its optical path deflected through an F$\theta$ lens 331-1 by a reflecting mirror 337 and projected onto the surface of the photosensitive drum 109 to form a bright line 339. Reference numeral 334 denotes an index sensor for detecting the start of the beam scanning operation, and numerals 335 and 336 denote cylindrical lenses for correcting the angle of inclination. Reference numerals 338*a*, 338*b* and 338*c* denote reflecting mirrors for forming beam scanning and detecting optical paths.

When the scanning operation is started, the beam is detected by the index sensor 334 so that its modulation is started with the first color signal. The beam thus modulated scans the photosensitive drum 109 which has been uniformly charged in advance by a charging device 241 of FIG. 10. A latent image corresponding to the first color is formed on the drum surface by the main scanning operation with the laser beam and by the auxiliary scanning operation resulting from the rotations of the photosensitive drum 109. This latent image is developed to form a toner image on the drum surface by a developing device 243 which is charged with a red toner, for example. The toner image thus obtained is caused, while being retained on the drum surface, to pass below a cleaning device 246 spaced apart from the photosensitive drum surface and to enter a subsequent copying cycle. The photosensitive drum 109 is charged again by the charging device 241.

Next, a second color image outputted from the signal processing unit E is inputted to the write unit B so that it is written in the drum surface to form a latent image like the case of the aforementioned first color signal. This latent image is developed by a developing device 244 which is charged with a toner of second or blue color. This blue toner image is formed on the aforementioned red toner image which has already been formed.

Reference numeral 245 denotes a developing device containing a black toner for forming a black toner image on the drum surface on the basis of a control signal generated by the signal processing unit E. The developing devices 243, 244 and 245 described above have their sleeves supplied with the a.c. and d.c. biases to conduct the jumping developments with the two-component toners so that the photosensitve drum 109 grounded to the earth is subjected to a non-contact development.

The superposed image having the toner images developed with the first color signal, the second color signal and the black toner is transferred by a transfer electrode 250 to a sheet of recording paper 261 which has been fed by a feed belt 264 and a feed roller 263 of the paper feeding unit. The transfer paper having the toner image transferred thereto is separated from the photosensitive member by a separating electrode 251 and is conveyed to and fixed by a fixing device 252 to provide a color hard copy.

The cleaning device 246 is brought into contact with the photosensitive drum 109 having ended the transfer to clear the drum surface of the unnecessary toner with its blade 247. The roller 249 of the cleaning device is used to remove a small quantity of toner left between the drum surface and the blade 247, when this blade leaves the drum surface for subsequent exposure and development after the cleaning operation. Thus, the roller 249 rubs the contact portion with the drum surface, while rotating in the direction opposite to that of the drum, to recover the residual toner.

Figure 12:
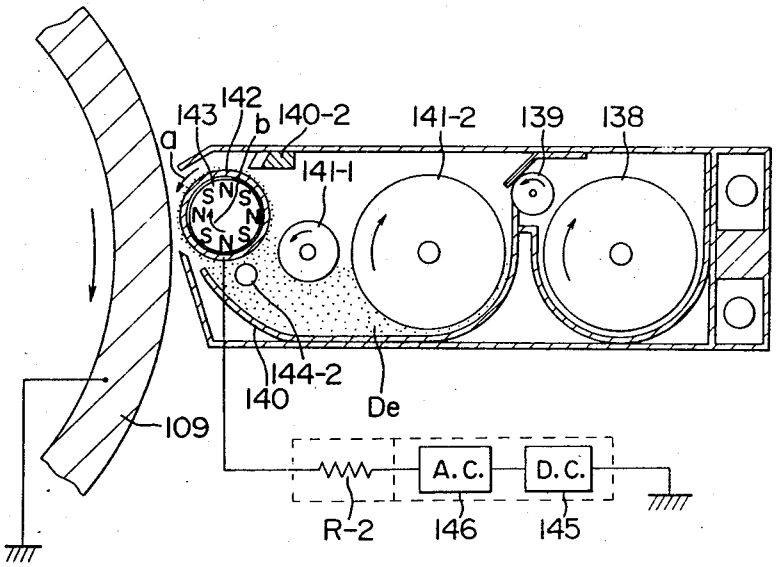

Each of the developing devices 243, 244 and 245 of the color image forming apparatus of FIG. 10 has the construction of FIG. 12, which is identical to that of the developing device of FIG. 5 except the following three points (i), (ii) and (iii), and the same parts as those of FIG. 5 are denoted at the same reference numerals in FIG. 12:

(i) The rotating directions of the sleeve 142 and the magnetic roll 143 are reversed from those of FIG. 5;

(ii) The position of an ear regulating blade 140-2 is changed from that of FIG. 5 in accordance with the rotational direction of the sleeve 142; and (iii) A scraper 144-2 has its position changed from that of FIG. 5 in accordance with the rotational direction of the sleeve 142 and is made of a magnetic material since it is buried in the developer De within the developer reservoir. This is because the developer left on the sleeve 142 is removed from the sleeve 142 so that it may be stirred together with the developer De.

The running conditions for the image formation were as follows:

Image Forming Conditions:
- Image Retainer:
  - Photosensitive Layer: OPC (Organic Photoconductive Material);
  - Drum Diameter: 140 mm; and
  - Linear Velocity: 58 mm/sec;
- Surface Potential:
  - Charge Potential (at Non-Image Portion during Development): −650 V; and
  - Potential at Exposed Portion: −10 V;
- Image Exposing Condition:
  - Light Source: Semiconductor Laser;
  - Wavelength: 780 ±20 nm; and
  - Recording Density: 16 dots/mm;
- Developing Device:
  - Sleeve: Made of non-magnetic stainless steel having a diameter of 18 mm and rotated at a linear velocity of 20 mm/sec;
  - Magnet: Having 8 poles and rotated at 600 r.p.m. and
  - Magnetic Flux Density: 700 gausses (at sleeve surface);
- Developer:
  - Carrier:
    - Magnetic Powder Resin Dispersed System;
    - Average Particle Diameter (Weight-Based); 20 $\mu$m;

Specific Resistance: $10^{14}$ Ωcm or more; and
Magnetization: about 50 emu/g (δ1 000), δ1 000: Magnetization in magnetic flux density of 1,000 gausses;

Toners:
Red (R):
Average Particle Diameter (Weight-Based): 11 μm;
Average Charge: 10 μC/g (for toner density of 15 wt%);
Blue (B):
Average Particle Diameter (Weight-Based): 11 μm;
Average Charge: 11 μC/g (for toner density of 15 wt%);
Black (K):
Average Particle Diameter (Weight-Based): 11 μm;
Average Charge: 12 μC/g (for toner density of 15 wt%);

Developing Condition:
Gap between Photosensitive Member and Sleeve: 1.0 mm;

Developer Layer Thickness:
0.2 to 0.8 mm (Stationary)
(Regulated by Non-Magnetic Blade);
(The conditions specified above are common.)

Developer Feed Rates (Actually Measured):
Red Developing Device: I 0.030 g/cm$^2$;
Blue Developing Device: II 0.025 g/cm$^2$;
Black Developing Device: III 0.032 g/cm$^2$;
(These three feed rates may be set commonly at 0.025 g/cm$^2$).

Developing Biases:
A (R): DC - 500 V; AC - 1.0 kV (Effective Value), 2 kHz;
B (B): DC - 500 V; AC - 1.0 kV (Effective Value), 2 kHz;
C (K): DC - 500 V; AC - 0.8 kV (Effective Value), 2 kHz;

Developing Order:
R→B→K;

Other Processing Methods:
Transfer: Corona Transfer;
Fixing: Heat Roller under Pressure; and
Cleaning: Blade and Cleaning Roller.

An image of sufficient density was obtained by the present experiment. The images of color toners such as the red and blue toners obtained had an excellent evenness and a high quality.

The black image portion had a reflective density of 1.1 or more (at the exposed portion), and the non-image portion had no fogging and toner scatter found.

Moreover, a sufficiently high density was obtained even if the linear velocity of the photosensitive member was accelerated from 58 mm/sec to 120 mm/sec and to 230 mm/sec.

Figure 13:
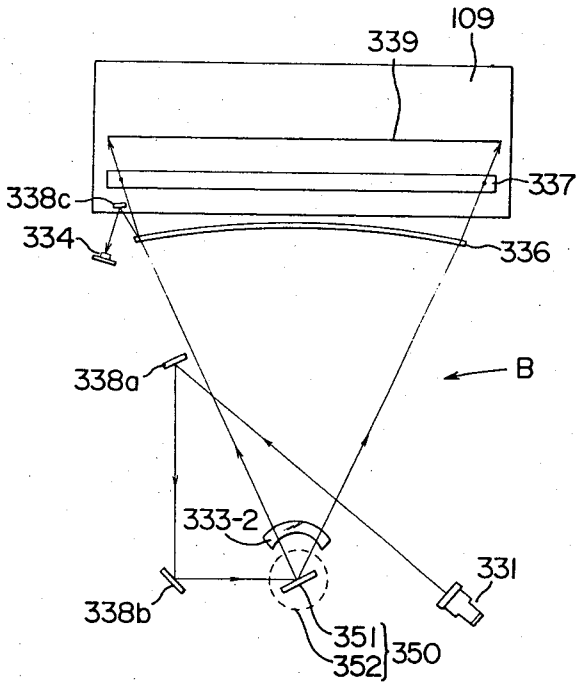

The apparatus of FIG. 10 can use, in place of the rotating polygonal mirror 332 (as shown in FIG. 11) of the laser writing unit, a vibrating rotational type mirror unit (which is called the "galvano mirror") having similar functions. This write unit B is constructed, as shown in FIG. 13, so that the laser beam emitted from the semiconductor laser 331 is vibratorily scanned by a galvano mirror 351, which is vibrated by a drive unit 352, and has its optical path deflected through a $\sin^{-1}\theta$ lens 333-2 by the reflecting mirror 337 until it is projected on the surface of the photosensitive drum 109. The remaining construction is similar to that of FIG. 11.

Figure 14:
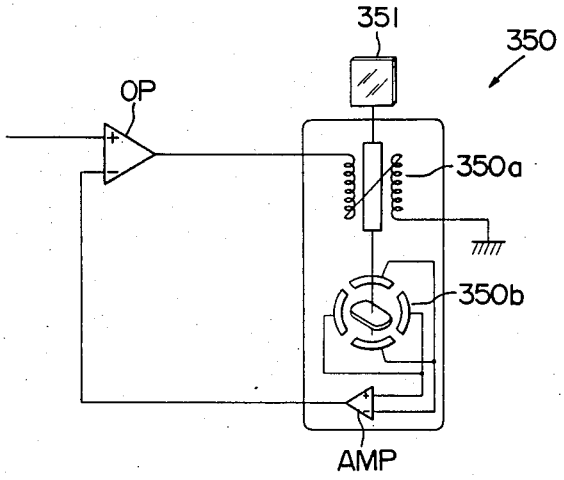
FIG. 14 is a schematic diagram showing one example of the principle of the mirror drive of the laser writing system of FIG. 13.

FIG. 14 shows the principle of a mirror vibrating mechanism 350. An operation amplifier OP is made receptive of both a position signal and an analog input signal from an amplifier AMP, which is connected through a position sensor **350*b* with a magnetic drive unit 350*a*, to drive the magnetic drive unit 350*a* thereby to vibrate a galvano mirror 351** fixed on a vibrator reciprocally a predetermined stroke with the current flowing through the coil.

Figure 15:
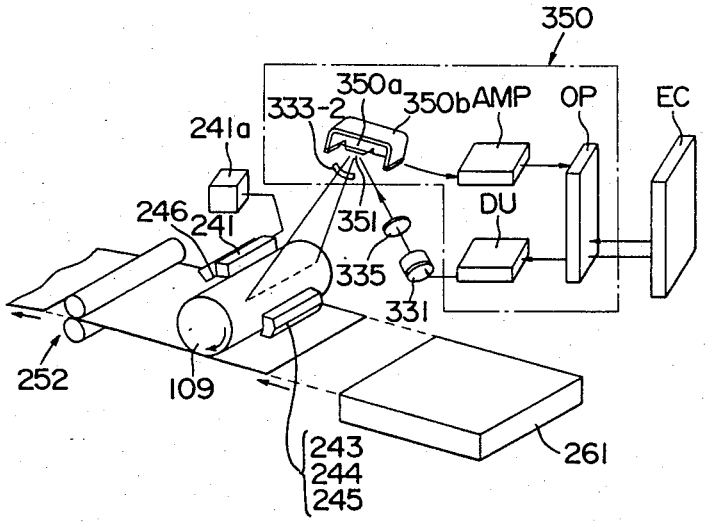
FIG. 15 is a schematic diagram showing a color printer using the laser writing system of FIG. 13.

In FIG. 15 schematically showing a color printer using the write unit B of FIG. 14: reference letters EC denote an external control unit; letters DU a drive unit for driving the semiconductor laser 331; and numeral **241*a* a power source for the charging device 241. The other parts shared with FIGS. 10 and 14** are denoted at the common reference numerals.

Experiment 1 for Comparison

The developments were conducted under the same conditions as those of the foregoing Experiment 1 except that the developer feed rate was selected at two points, i.e., 0.05 g/cm$^2$ and 0.08 g/cm$^2$. As a result, the fogging of the non-image portion increased the more for the higher feed rate, and the carrier stick to and the toner scatter over the image portion became so prominent that they could not be practically used for a long time.

Experiment 2 for Comparison

The developments were conducted under the same conditions as those of the foregoing Experiment 1 except that the developer feed rate was selected at two points, i.e., 0.007 g/cm$^2$ and 0.005 g/cm$^2$. As a result, the image density at a portion having a potential difference of 800 V between the image and non-image portions dropped for the lower feed rate and took 0.95 and 0.70 at the maximum, respectively.

Experiment 3 for Comparison

An Image was formed under the same conditions as those of the Experiment 3 except that the developer feed rate was set at 0.52 g/cm$^2$ for the black. The image formed had the carrier stick, the fogging and the uneven development.

Incidentally, the photosensitive member, the developer and so on to be used in the present invention should not be limited to the above-specified examples but can be modified in various manners unless they depart from the scope of the present invention. For example, the photosensitive member may be formed with a photoconductive layer of amorphous silicon, or the developer may have its carrier prepared by coating ferrite powder having a particle diameter or 10 to 40 μm with a resin.

As has been described hereinbefore, according to the present invention, the development is conducted at a feed rate of developer to the developing region within a range of 0.01 to 0.04 g/cm$^2$, under the alternating electric field and in the non-contact manner. As a result, the following effects can be obtained.

The whole layer of the developer can freely move on the developer feeding member so that the developer is more actively stirred and interchanged from the lower to surface layers by the action of the alternating magnetic field. As a result, it is possible to obtain a visible image of excellent quality having an even and sufficient density with no carrier stick and fogging without being accompanied by the complicated and large-sized developing apparatus.

What is claimed is:

1. A method for reversal developing an electrostatic latent image on the surface of an electrostatic image support member which comprises the steps of:

(1) forming an electrostatic latent image on said surface, (2) controlling the rate of feeding an electrostatically charged developer to a developing region within a range of 0.01 g/cm$^2$ to 0.04 g/cm$^2$, (3) transferring said developer into said developing region by means of a developer transfer member, and (4) applying an a.c. field between said electrostatic image support member and said developer transfer member whereby to develop said electrostatic latent image in accordance with a non-contact developing system.

2. The developing method according to claim 1, wherein said developer is a two-component developer.

3. The developing method according to claim 2, wherein said two-component developer consists of a magnetic carrier and a non-magnetic toner.

4. The developing method according to claim 3, wherein the resistance value of said magnetic carrier is $10^{14}\Omega$cm or more.

5. The developing method according to claim 3, wherein said magnetic carrier is spherical.

6. A method for developing an electrostatic latent image on the surface of an electrostatic image support member which comprises the steps of:

(1) forming an electrostatic latent image on said surface, (2) controlling the rate of feeding an electrostatioally charged developer which comprises a magnetic carrier and a non-magnetic toner to a developing region within a range of 0.01 g/cm$^2$ to 0.04 g/cm$^2$, (3) transferring said developer into said developing region by means of a developer transfer member, and (4) applying an a.c. field between said eletrostatic image support member and said developer transfer member whereby to develop said electrostatic latent image in accordance with a non-contact developing system.

7. The developing method according to claim 6, wherein the resistance value of said magnetic carrier is $10^{14}\Omega$cm or more.

8. The developing method according to claim 6, wherein said magnetic carrier is spherical.

* * * * *